US008931849B2

(12) United States Patent
Kusch et al.

(10) Patent No.: US 8,931,849 B2
(45) **Date of Patent: *Jan. 13, 2015**

(54) SEATING FURNITURE

(75) Inventors: Dieter Kusch, Liesen (DE); Robert De Le Roi, Frankenberg (DE); Karl-Heinz Seipp, Allendorf (DE)

(73) Assignee: Kusch + Co. GmbH & Co. KG, Hallenberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/575,729

(22) PCT Filed: Jan. 13, 2011

(86) PCT No.: PCT/EP2011/000122

§ 371 (c)(1), (2), (4) Date: Jul. 27, 2012

(87) PCT Pub. No.: WO2011/091954

PCT Pub. Date: Aug. 4, 2011

(65) Prior Publication Data

US 2012/0299348 A1 Nov. 29, 2012

(30) Foreign Application Priority Data

Jan. 29, 2010 (DE) ..... 10 2010 006 175

(51) Int. Cl.
*A47C 7/00* (2006.01)
*A47C 7/02* (2006.01)
(Continued)

(52) U.S. Cl.
CPC . *A47C 5/12* (2012.01); *A47C 1/124* (2013.01); *A47C 4/02* (2013.01); *A47C 4/03* (2013.01); *A47C 11/005* (2013.01)
USPC ..... 297/440.11; 297/440.2; 297/440.22; 297/452.13

(58) Field of Classification Search
CPC ..... A47C 1/124; A47C 4/30; A47C 11/005; A47C 31/02; A47C 31/023
USPC ..... 297/248, 218.4, 218.1, 440.11, 440.15, 297/440.2, 440.22, 452.13, 452.19, 452.59, 297/232
See application file for complete search history.

(56) References Cited

U.S. PATENT DOCUMENTS 3,114,575 A * 12/1963 Eames et al. ..... 297/248
3,226,071 A * 12/1965 Eames et al. ..... 248/163.1
(Continued)

FOREIGN PATENT DOCUMENTS

DE 8620412 U1 9/1986
GB 1389265 A 4/1975

OTHER PUBLICATIONS

U.S. Appl. No. 13/575,706, Seating Furniture, based on PCT/EP2011/000123, filed Jan. 13, 2011.

*Primary Examiner* — Ryan Kwiecinski
(74) *Attorney, Agent, or Firm* — Kilpatrick Townsend & Stockton LLP

(57) ABSTRACT

The invention relates to seating furniture comprising two frames arranged at a distance to each other on a support, between which frames a seat part and a backrest part can be mounted, and the frames have one upper frame part and a lower frame part each which mechanically immobilize the seat part and the backrest part a the sides thereof. The upper frame part and the lower frame part are clamping elements that can be braced with each other. At least one clamping element has a laterally extending recess on each edge which recess forms a frame groove in which a respective engaging element provided on the edges of the seat part and of the backrest part can be mounted by way of a frictional connection to the upper frame part and the lower frame part. The recess has an undercut portion which forms a stop for holding the clamped engaging element by a form fit.

16 Claims, 7 Drawing Sheets

Figure 1A:
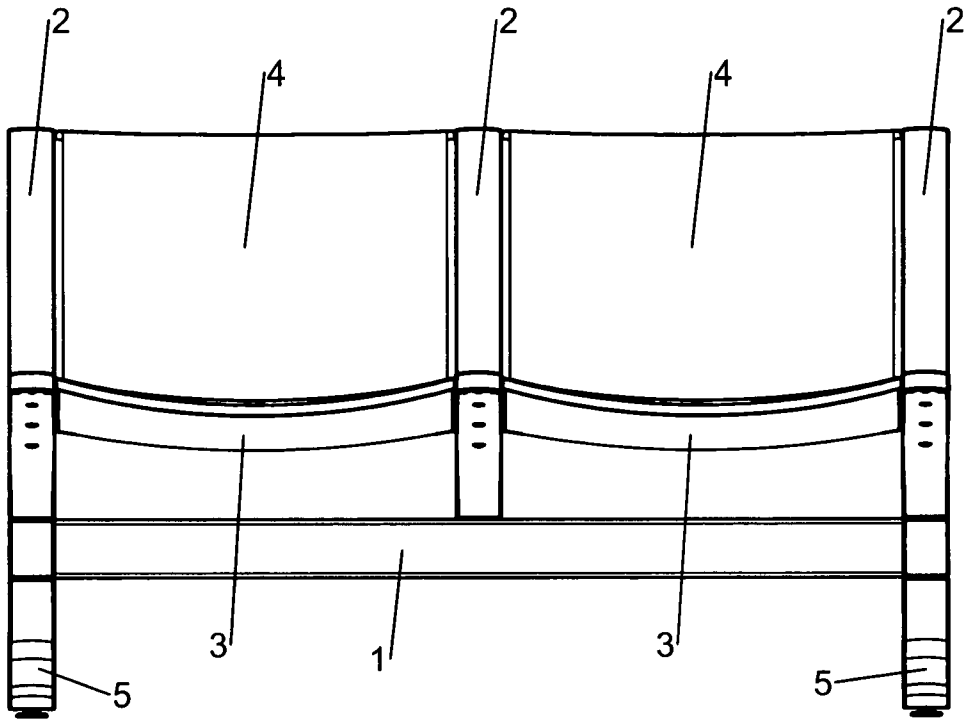

(51) Int. Cl.

| | |
|---|---|
| ***A47C 5/12*** | (2006.01) |
| ***A47C 1/124*** | (2006.01) |
| ***A47C 4/02*** | (2006.01) |
| ***A47C 4/03*** | (2006.01) |
| ***A47C 11/00*** | (2006.01) |

(56) References Cited

U.S. PATENT DOCUMENTS

| | | | | |
|---|---|---|---|---|
| 3,431,022 | A * | 3/1969 | Poppe et al. | 297/448.1 |
| 3,640,576 | A * | 2/1972 | Morrison et al. | 297/440.11 |
| 4,043,591 | A * | 8/1977 | Lehmann | 297/248 |
| 4,438,603 | A | 3/1984 | Durkan | |
| 4,601,516 | A | 7/1986 | Klein | |
| 4,848,843 | A * | 7/1989 | Gibbs | 297/440.22 |
| 5,338,091 | A * | 8/1994 | Miller | 297/218.4 |
| 6,560,827 | B1 * | 5/2003 | Gross | 24/265 C |
| 7,040,834 | B2 * | 5/2006 | Nardi | 403/329 |
| 2012/0248844 | A1 * | 10/2012 | Lee | 297/440.11 |

* cited by examiner

SEATING FURNITURE

The invention relates to a seating furniture, in particular a chair or bench.

DE-A 1 429 358 discloses a chair or bench for use as home furniture or seating in public buildings. In the field of public seating, for example waiting rooms, airports, lobbies and the like, the demands placed on seating facilities are exceptionally high. One of the fundamentals is that the seating furniture provides a high level of sitting comfort. Because of the amount of usage and partially also because of the carelessness of the users, such seating furniture rapidly becomes damaged and unsightly. Because of the resulting high cost of labor and material for maintenance, the cleaning and replacement have to be made quick and simple.

In order to satisfy these demands, the known seating furniture has a strong, durable frame which can be standardized and thereby minimizes the number of individual components for assembling the seating furniture. The seat and back pads can be removed easily and quickly, since the pads are separate and individual for each seat. Damage to one seat may be repaired by replacement of the particular pad involved simply by its removal and the substitution of a new pad. The pads are identical, irrespective of whether they are utilized for an end seat or for an intermediate seat, where multiple seating is employed. Preferably, separate seat and back pads are used.

Each frame has a pair of cover plates, which, in case of the seat portion, forms the top surface of the frame and in the case of the back portion forms the front surface of the frame. The cover plates are removable. The seat pads are suspended between the frames by placing their edge margins between the frames and the cover plates and clamping the cover plates down tightly on them to anchor the pad edges. In addition, the seat and back pads each are provided with grommets in their edge margins for reception of studs. These provide an additional anchor for the seat and back pads and reinforce the clamping formed between the cover plates and the frames.

Disadvantageous is the complicated anchoring of the edges margins between the frame and the cover plates using grommets, which have to be fitted by way of studs. This also results in the need to define particular wall thicknesses of the pads which can be anchored to the frame.

The object of the invention is, therefore, to provide a seating furniture which provides a high and long-lasting level of sitting comfort and can be simply assembled and changed.

As a result, a seating furniture is made which has the advantages of a standardized frame having seat parts and back parts that can be replaced separately and at the same time delivers good and long-lasting sitting comfort. The seat and back parts are clamped in a frame joint, for which purpose the seat and back part has in each case an engagement member on the periphery, said engagement member being fastenable in the frame joint via a frictional connection. This clamping fit is secured in a form-fitting manner by a stop. A quickly detachable, but in the process secure and resistant clamping connection is created according to the invention.

The provision of an engagement member makes it possible for the fastening of the seat part and back part to be separate from the material and the material thickness that are used for the seat part and back part. The engagement members provided on either side of a seat part and back part thus form facings as part of a clamping connection, into which said facings engage. This joint function is separate from the type and thickness of the material or pad used, since it is possible not only to shape but also to attach the respective engagement member at the peripheral edges of the seat part and back part.

As engagement member, it is possible to provide for example a shaped piece or shaped body which can be formed in one piece with a seat part and back part. Alternatively, the shaped piece can be in the form of an attachment piece which is fastened to or onto the peripheral edge of a seat part or back part. This applies in particular when use is made of materials having a small thickness, such as metal sheets, skins, fabric sheets and other sheet-like materials. Different materials and material thicknesses can be used without the clamping bodies of the frame having to be altered. Assembled seating furniture can thus be fitted with varying seat parts and back parts.

Preferably, the clamping connection is secured against displacement in the pressing plane, i.e. transversely to the clamping direction, by a support fit. The fit can also reinforce the structure of the frame. Thus, it is possible, for example, for the fitting part in the form of a tongue to form a reinforcement rib for the top frame part. The top frame part can then be designed in a thin manner like a cap.

Furthermore, the top frame part can have a T-shaped cross section having a bar on its underside, said bar being arranged particularly preferably in the center. This bar can be provided, as a tongue of a fit, entirely or partially along the extent of the top frame part. Free spaces in the shade of the bar can be used as installation spaces for the attachment of accessories, such as an armrest, for example. Fastening means, such as screws, for example, act from the inside of the frame and are covered when the top frame part and the bottom frame part are braced. As a result, the external appearance of the seating furniture is improved.

In order to brace the top frame part and the bottom frame part, a number of tensioning screws can be used. The fitting part of a tongue can form a clamping bridge for the tensioning screws. A head- (turnbuckle-) screw connection which is not visible from the front enables secure bracing, without the appearance of the front of the seating furniture being impaired by visible screws.

The frame provided according to the invention is suitable as an end frame or as an intermediate frame. When it is used as an end frame, a blind shaped piece for closing off the frame joint can be provided on the end side of the seating furniture.

Further embodiments of the invention will become apparent from the following description and the dependent claims.

The invention is explained in more detail hereafter on the basis of the exemplary embodiments illustrated in the appended drawings.

Figure 1B:
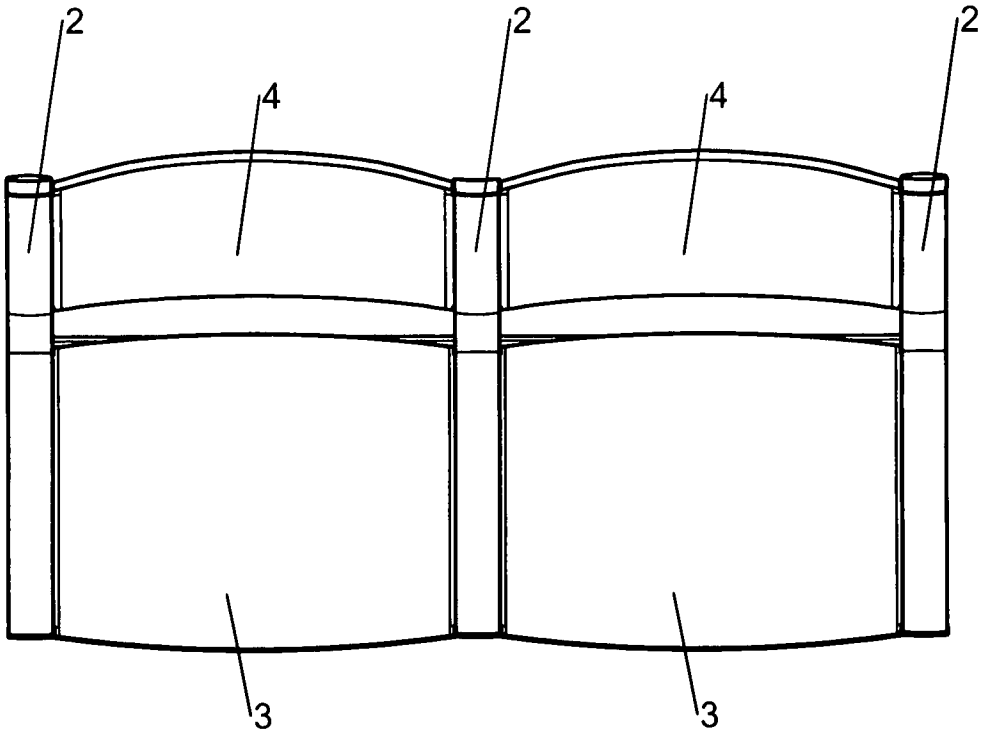

FIG. 1*a* schematically shows a front view of a seating furniture,

FIG. 1*b* schematically shows a plan view of the seating furniture according to FIG. 1*a,*

Figure 1C:
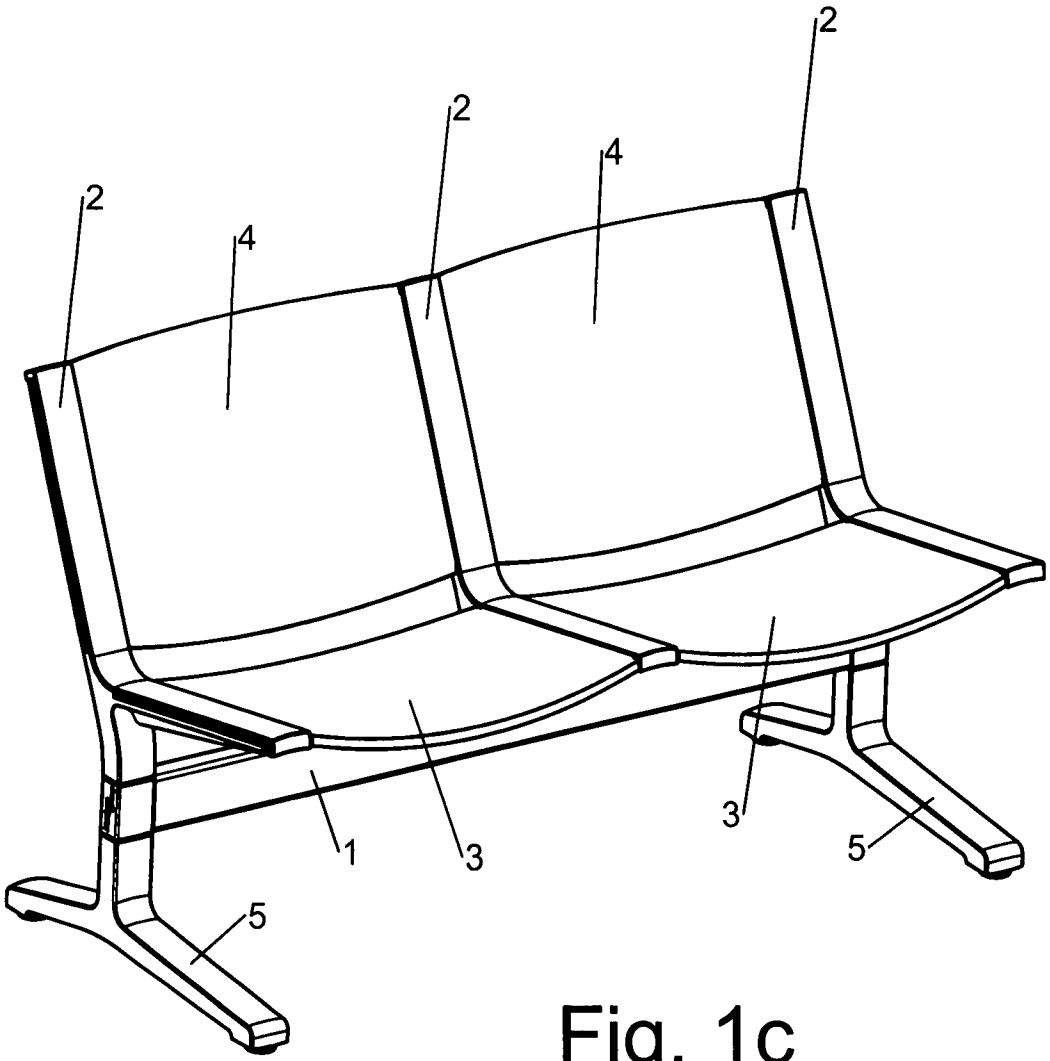

FIG. 1*c* schematically shows a perspective side view of the seating furniture according to FIG. 1*a,*

Figure 2:
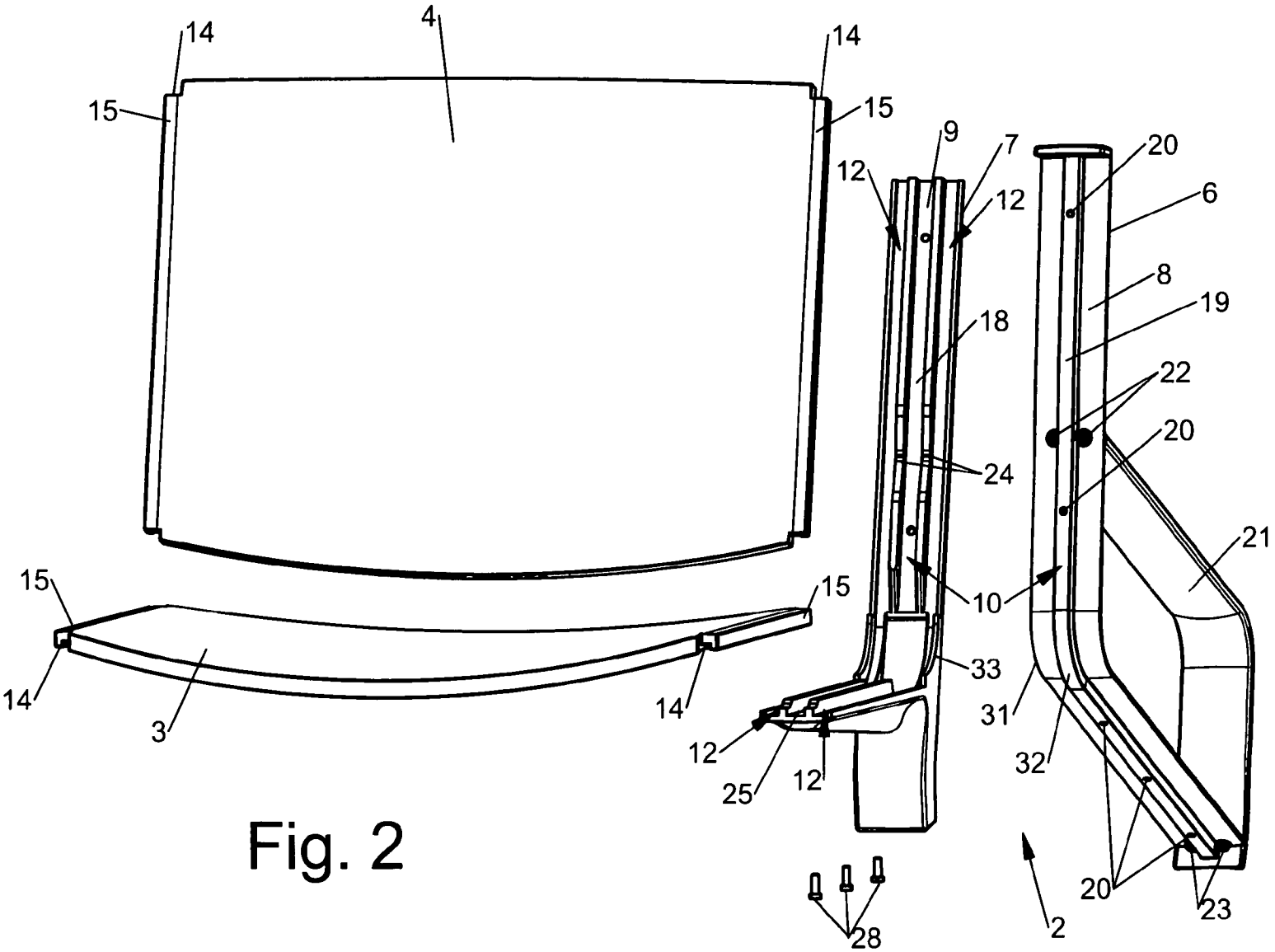
Figure 3:
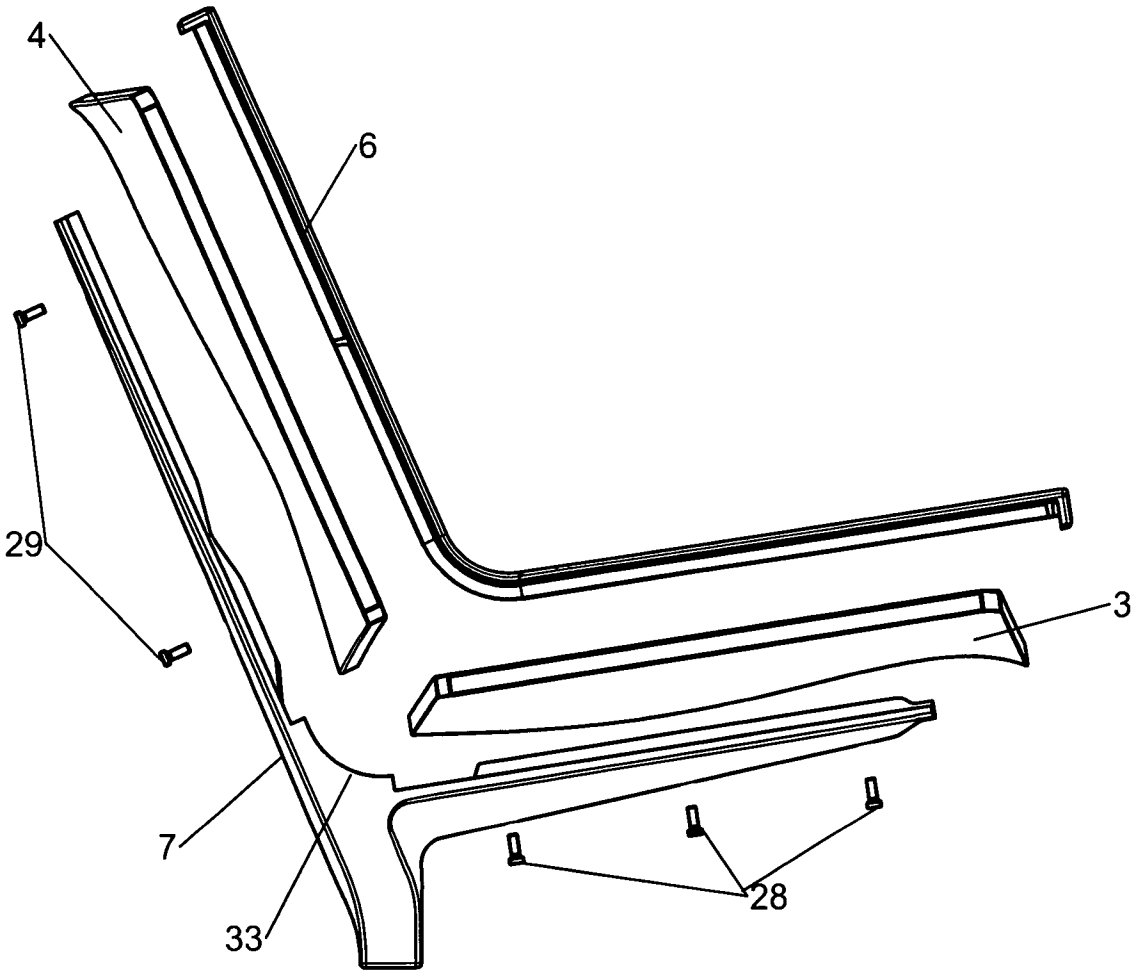
Figure 4:
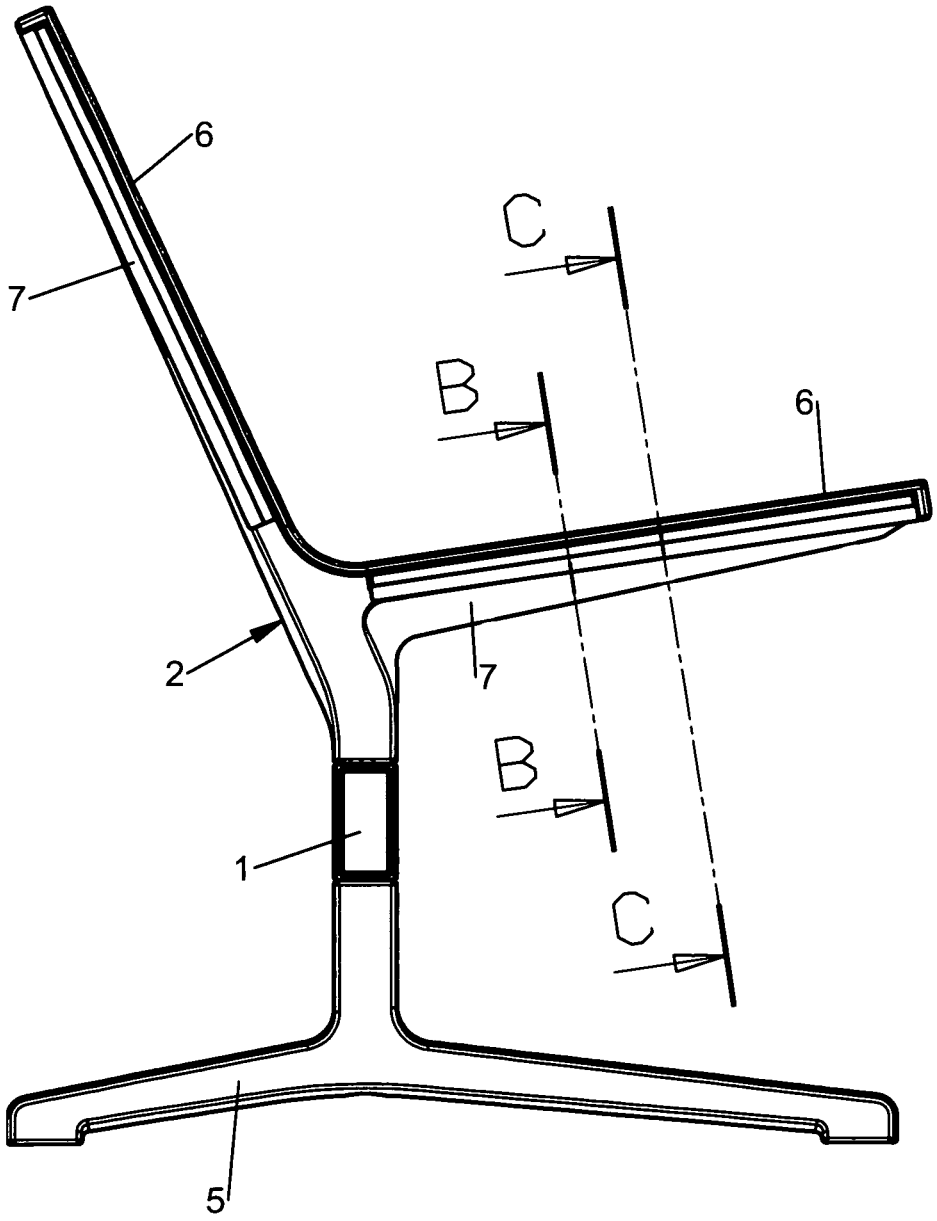
Figure 6:
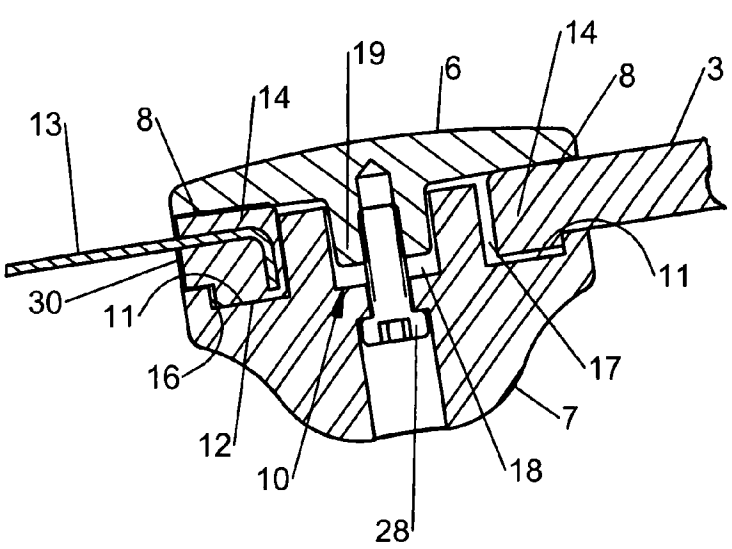
Figure 5:
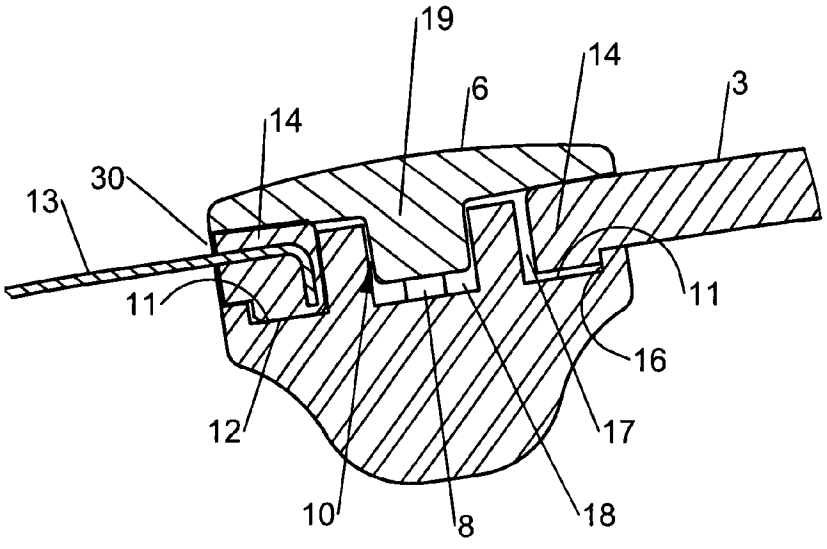

FIG. 2 schematically shows an exploded view of a frame and a seat part and back part of a seating furniture, FIG. 3 schematically shows a side view of a frame having a top frame part and a bottom frame part prior to the bracing thereof, FIG. 4 schematically shows a side view of a seating furniture, including the illustration of a support, FIG. 5 shows a section B-B as per FIG. 4, FIG. 6 shows a section C-C as per FIG. 4.

As the figures show, the invention relates to a seating furniture having at least two frames 2, which are arranged in a manner spaced apart from one another on a support 1 and between which a seat part 3 and a back part 4 can be suspended. The seating furniture is preferably a chair having one seat or a bench having multiple seating successively arranged.

FIG. 1*a* to FIG. 1*c* show by way of example a seating furniture having two seats successively arranged, forming a bench. Therefore, a total of three frames 2 are provided, wherein two external frames 2 each form an outer frame and the central frame 2 forms an intermediate frame. All of the frames 2 can be formed in the same manner, as a result of which a standardized frame system is formed. Each seat part 3 and back part 4 is mounted at the periphery and on both sides to a frame 2, in order to form a seat. The number of seats can be chosen. All of the frames 2 of a row of seats can be attached to a common support 1, which is held by a foot part 5 (FIG. 4). In the case of more than six seats, preferably at least one intermediate foot (not illustrated) is provided.

As FIG. 2 and FIG. 3 show, a frame 2 comprises in each case a top frame part 6 and a bottom frame part 7, which mechanically fix the seat part 3 and the back part 4 at the periphery. Therefore, the top frame part 6 and the bottom frame part 7 are braceable clamping members. As FIG. 3 shows, the top frame part 6 is braced with the bottom frame part 7 by means of fastening elements. Preferably, head-screw connections are provided to brace the top frame part 6 and the bottom frame part 7. By tightening preferably tensioning screws 28, 29, which are put through the bottom frame part 7 and can be screwable into the top frame part 6, the top frame part 6 and the bottom frame part 7 form clamping bodies for mechanically fixing a periphery of the seat part 3 and of the back part 4.

FIG. 2 shows the top frame part 6 with its underside 8 swung open with respect to a top side 9 of the bottom frame part 7.

At least one of the clamping bodies, here preferably the bottom frame part 7, has a hollow 12 that extends in each case at the periphery. This hollow 12 is a recess, the walls of which provide effective surfaces 11 for static friction. As FIG. 2 shows, the hollow 12 extends preferably along the bottom frame part 7 in a manner corresponding to a depth/height of the seat part 3 and back part 4. The hollow 12 is provided preferably on both sides at the periphery of the bottom frame part 7. If the top frame part 6 and the bottom frame part 7 thus formed are braced, the clamping force occurs in a frame joint 30, which forms preferably a pressure collar for an insertable/introducible engagement member 14. An engagement member 14 is provided on both of the opposing peripheral edges 15 of the seat part 3 and back part 4.

The engagement member 14 extends in a bar-shaped manner along the respective periphery of the seat part 3 and back part 4, such that mechanical fixing on both sides is achieved. The engagement members 14 provided on both sides of the seat part 3 and back part 4 are preferably shaped pieces or shaped bodies, which extend continuously or discontinuously. Between the top frame part 6 and the bottom frame part 7, the engagement members 14 are each mechanically fixed in a pressing space in the frame joint 30, said pressing space being bordered by the effective surfaces 11 of the hollow 12 in conjunction with the bottom surface 8 of the top frame part 6. Each engagement member 14 is consequently fastened by a frictional connection between the top frame part 6 and the bottom frame part 7. The frictional connection, produced by static friction, of the clamped engagement member 14, which establishes a clamping fit, is secured in a form-fitting manner. The hollow 12 has an undercut 16, which forms a stop for securing the clamped engagement member 14 in a form-fitting manner.

The undercut 16 is formed preferably by a shoulder, which narrows the frame joint 30 at the outside surface.

As FIG. 5 and FIG. 6 show, the hollow 12 in the at least one clamping element has an undercut 16, which can be brought into engagement in a form-fitting manner with the engagement member 14, which is then preferably in the form of an angled shaped piece. To this end, the hollow 12 preferably forms a frame joint 30 having a longitudinal groove 17.

The underside 8 and the top side 9 of the frame parts 6, 7 form clamping jaws, which form counterparts that can be aligned with one another preferably by a connection 10 of parts that engage in one another. The connection 10 has preferably a groove 18 and a tongue 19. The connection 10 is preferably a fit. The fit can be in the form of a clearance fit. The fit can serve as a support.

As FIG. 2 shows, the tongue 19 can form a clamping bridge for transmitting the tensioning force of the tensioning elements, for example tensioning screws 28, 29, to the frame 2. To this end, the tongue 19 has an internal thread 20 for head-screw connections.

The bottom frame part 7 is formed preferably as a side member having multiple profiles on its top side, it being possible to brace said side member with a side member, which is T-shaped on its underside, as the top frame part 6.

The tongue 19 forms, preferably on the underside (inner side) of the top frame part 6, a reinforcement rib having a rib longitudinal axis that extends along the extent of the top frame part 6.

The engagement member 14 can be formed in one piece with the seat part 3 and back part 4. Alternatively, the engagement member 14 can be fastened as an attachment piece to a seat part 3 and back part 4 in the form of a sheet-like structure 13, as is illustrated for example in FIG. 5 and FIG. 6. The engagement member 14 as attachment piece consists preferably of a plastics material or plastics composite material. The engagement member 14 as attachment piece can receive one end of the sheet-like structure 13 or clamp the latter as an insert (not illustrated) in the hollow 12.

The top frame part 6 and the bottom frame part 7 are preferably both L-shaped clamping bodies, which connect a seat part 3 and a back part 4 of a frame 2 together in one part. The seat part 3 and the back part 4 can be formed separately or in one part/piece as a seat shell. FIG. 2 shows the top frame part 6 in a one-part form having a lower seat-part clamping section, an upper back part clamping section and an arcuate transition section 31 arranged in between. The transition section 31 can have an internal reinforcement rib 32 which can be a part of the tongue 19. The top frame part 6 can be connected to the bottom frame part 7 in a flush manner at the periphery in the region of the arcuate transition section. To this end, there can be provided webs 33 (FIG. 2) which can delimit the frame joint 30 on the abutment side.

An armrest 21 can be fastened to the top frame part 6 by means of fastening elements 22, 23 which are on the inside of the frame 2 when the top frame part 6 is braced with the bottom frame part 7. The groove 18 can have cutouts 24, 25 adapted thereto in order to form an installation space.

The invention claimed is:

1. Seating furniture, comprising at least two frames which are arranged at a distance horizontally to each other on a support and between which the at least two frames a seat part and a back part are suspended, and the at least two frames each have a top frame part and a bottom frame part which mechanically fix the seat part and the back part at the periphery, wherein the top frame part and the bottom frame part comprise releasably braceable clamping bodies, at least one of the releasably braceable clamping bodies has a hollow that extends to an open side of a peripheral edge of the top frame part and the bottom frame part and forms a frame joint in which an engagement member that is provided at a respective peripheral edge of the seat part and of the back part is fastened by frictional connection to the top frame part and bottom frame part, and the hollow has an undercut which forms a stop for securing the engagement member in a form fitting manner.

2. The seating furniture as claimed in claim 1, wherein the top frame part is formed in one piece in order to fasten the seat part and back part.

3. The seating furniture as claimed in claim 2, wherein the top frame part is formed in an L-shaped manner, having a seat-part clamping section, a back-part clamping section and an arcuate transition section arranged in between.

4. The seating furniture as claimed in claim 3, wherein the arcuate transition section has an internal reinforcement rib.

5. The seating furniture as claimed in claim 3, wherein the top frame part is connected to the bottom frame part in a flush manner at the periphery in the region of the arcuate transition section.

6. The seating furniture as claimed in claim 1, wherein the undercut is in the form of a shoulder and the engagement member is in the form of a bar-shaped body.

7. The seating furniture as claimed in claim 1, wherein the hollow forms a pressure collar with a longitudinal groove.

8. The seating furniture as claimed in claim 1, wherein the braceable clamping bodies form counterparts that can be aligned with one another by a connection of parts that engage in one another.

9. The seating furniture as claimed in claim 8, wherein the connection has a groove and a tongue which form a fit.

10. The seating furniture as claimed in claim 9, wherein the tongue forms a clamping bridge for transmitting the tensioning force of tensioning elements to the frame.

11. The seating furniture as claimed in claim 1, wherein the engagement member is fastened as an attachment piece to a seat part and back part, wherein the seat part and the back part each comprise a sheet-like structure.

12. The seating furniture as claimed in claim 1, wherein the at least two frames serves as an end frame or as an intermediate frame.

13. The seating furniture as claimed in claim 1, wherein at least a third frame is fastened between foot parts.

14. The seating furniture as claimed in claim 1, wherein the engagement member consists of a plastics material.

15. The seating furniture as claimed in claim 1, wherein the seat part and the back part are in the form of a seat shell.

16. Seating furniture, comprising:

at least two frames which are arranged at a distance horizontally to each other, wherein each frame comprises a top frame part and a bottom frame part;

a seat part and a back part that are configured to be clamped between the top frame part and the bottom frame part so as to be suspended from the at least two frames, wherein the top frame part and the bottom frame part includes a peripheral edge defining a side;

at least one fastener that releasably clamps the top frame part to the bottom frame part, with the seat part and the back part sandwiched between the top frame part and the bottom frame part;

wherein at least one of the top frame part or the bottom frame part includes an elongate hollow that forms an opening in the side and that forms a frame joint;

wherein an engagement member is provided at a side of the seat part and of the back part adjacent the side of the top frame part and the bottom frame part with the opening and is in direct contact with the top frame part and the bottom frame part when positioned within the hollow so as to provide a frictional connection to the top frame part and bottom frame part; and wherein the hollow has an undercut which forms a stop for securing the clamped engagement member in a form fitting manner.

* * * * *